United States Patent [19]

Fresard et al.

[11] 4,397,252

[45] Aug. 9, 1983

[54] SEWING THREAD CUTTING DEVICE WITH THREAD RETENTION APPARATUS

[75] Inventors: Marcel Fresard, Geneva; Jakob Jentschmann, Zurich, both of Switzerland

[73] Assignee: Mefina S.A., Fribourg, Switzerland

[21] Appl. No.: 243,831

[22] Filed: Mar. 16, 1981

[30] Foreign Application Priority Data

Mar. 17, 1980 [CH] Switzerland ..... 2068/80
Apr. 8, 1980 [CH] Switzerland ..... 2697/80

[51] Int. Cl.[3] ..... D05B 65/00
[52] U.S. Cl. ..... 112/299; 83/902
[58] Field of Search ..... 112/130, 285, 129, 299, 112/122; 28/226; 242/48; 139/302, 303; 83/902, 909

[56] References Cited

FOREIGN PATENT DOCUMENTS

| | | | |
|---|---|---|---|
| 485623 | 10/1929 | Fed. Rep. of Germany | 112/299 |
| 1158669 | 6/1958 | France . | |
| 544985 | 6/1956 | Italy | 112/299 |
| 556205 | 6/1977 | U.S.S.R. | 112/299 |

*Primary Examiner*—Werner H. Schroeder
*Assistant Examiner*—Andrew M. Falik
*Attorney, Agent, or Firm*—Emory L. Groff, Jr.

[57] ABSTRACT

A thread-cutting device comprises a rod provided with a head portion defining an inner circular stop having a cutting edge, each side of which interfaces a slider member, the slider members being concentrically mounted on the rod. A thread introduced between the head and the end of the slider member in contact with the head is retained between the head and the end of the slider member while it passes over the stop and is cut.

13 Claims, 4 Drawing Figures

SEWING THREAD CUTTING DEVICE WITH THREAD RETENTION APPARATUS

FIELD OF THE INVENTION

The present invention relates to a sewing thread cutting device, with thread retention, and more particularly to a cutting device which is adapted to be mounted on the casing or some other part of a sewing machine.

DESCRIPTION OF PRIOR ART

In French Pat. No. 1158669, there is disclosed a thread cutting device which is adapted to be mounted on the material presser bar of a sewing machine, and which comprises a disc having a peripheral cutting stop and a frusto-conical member co-axially mounted on the fixing screw which connects the material presser foot to the material presser bar of a sewing machine, the frusto-conical member being pressed against the cutting disc by a spring.

This known device has the disadvantage of only ensuring sufficient retention of the thread in the immediate vicinity of the axis of the screw and the risk of injury to the user by contacting the peripheral stop on the disc which is usually insufficiently protected.

BRIEF DESCRIPTION OF THE INVENTION

In accordance with the present invention, there is provided a sewing thread cutting device with thread retention, comprising a rod having a head portion, the head portion including a substantially circular stop member formed on its surface facing the rod, a first slider member being mounted on the rod and a second slider member being mounted on the first slider member, both slider members bearing against the head portion of the rod, one on each side of the substantially circular stop member such that the substantially circular stop member projects into a substantially annular housing defined between the outer surface of the first slider member and the inner surface of the second slider member.

BRIEF DESCRIPTION OF THE DRAWINGS

The invention will be further described, by way of example, with reference to the accompanying drawings, in which.

DESCRIPTION OF PREFERRED EMBODIMENTS

Figure 1:
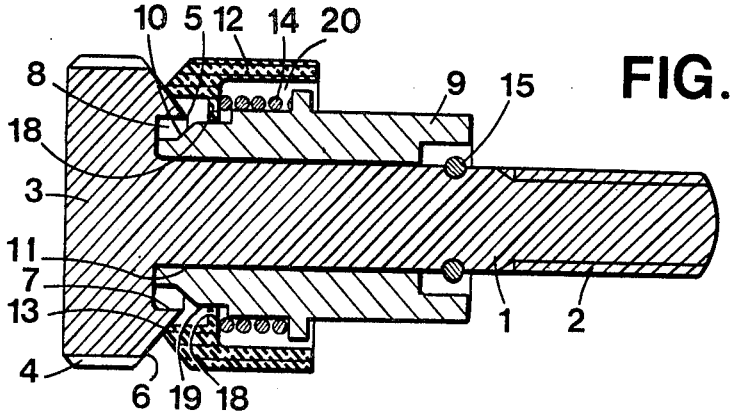
FIG. 1 is an axial sectional view of a first embodiment of a device in accordance with the present invention.

In FIG. 1, there is shown a cutting device comprising a rod 1 having a screw-thread 2 at one of its ends. At its other end, the rod has a head portion 3, a portion 4 of the periphery of which is knurled. The underside of the head 3, that is to say, the surface of the head 3 facing the rod 1, presents a peripheral stop 5 having a cutting edge formed at the intersection of the other, non-knurled frusto-conical portion 6 of the periphery of the head with the outer peripheral edge 7 of a circular groove 8. The groove 8 is cut in the surface of the head 3 facing the rod 1. A first slider member 9 is engaged on the rod 1. The end of the slider members adjacent the head 3 presents a clearance from the head 3, the slider end comprising a frusto-conical portion 10 so shaped as to permit it to penetrate into the groove 8 formed in the head 3 adjacent its inner peripheral edge 11. The portion 10 is, nevertheless, still spaced from the outer peripheral edge 7 of the groove 8 and also from the stop 5.

When the rod 1 is screw-fitted into a support such as, for example, the foot and the material presser bar of a sewing machine, the slider member 9 is pressed against the base of the groove 8 formed in the head 3. A second slider member 12 is engaged over the slider member 9 so as to be co-axial with the rod 1. The end of the slider member 12 facing the head 3 bears against the frusto-conical portion 6 of the periphery of the head 3 and is urged thereagainst by a spring 14.

Thus, a thread introduced into the device between the head 3 and the second slider member 12 is gripped between the frusto-conical portion 6 of the head 3 and a bearing end portion 13 of the slider member 12 and slides over the frusto-conical portion 10 of the throat of the slider member 9, in the direction of the groove 8, when one pulls thereon. This being done, the thread is forced to pass over the cutting edge of stop 5 and is cut thereby. A length of the thread is withdrawn from the device, whilst the other length is retained between the frusto-conical portion 6 of the head 3 and the bearing end 13 of the slider member 12.

So as to permit the strands of the thread which remain held in the annular housing defined between the outer surface of the first slider member 9 and the inner surface of the second slider member 12 to be removed, the slider member 9 is so mounted on the rod 1 that there is axial play between the base of the groove 8 and a ring 15 provided for retaining the member 9 on the rod 1. Similarly, the slider member 12 is mounted on the slider member 9 so that there is axial play therebetween.

This axial play of the slider member 12 on the slider member 9 is effected, by providing an inner circular rib 18 on the slider member 12 which is displaceable on a cylindrical portion 19 of the first slider member 9, on this side of the frusto-conical portion 10 of its end clearance, against the action of the spring 14. This rib 18 forms a baffle preventing the thread or thread debris from penetrating into the enclosure or housing 20 for the spring 14.

Figure 2:
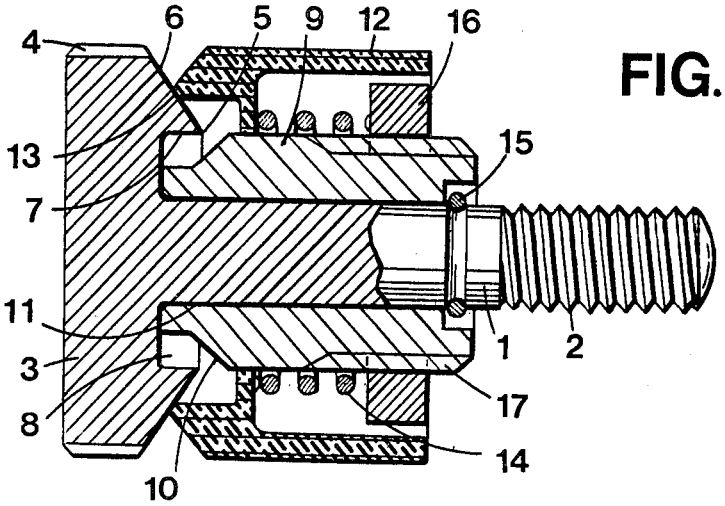
FIG. 2 is similar to FIG. 1 of a second embodiment of a device in accordance with the present invention.
Figure 3:
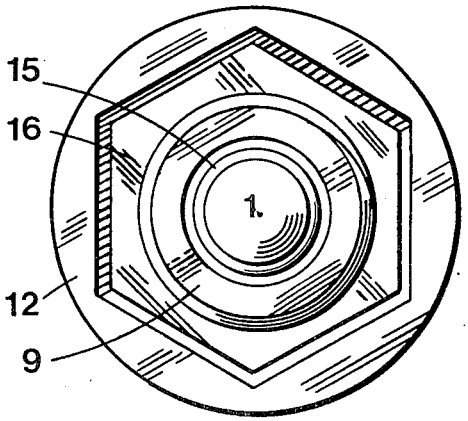
FIG. 3 is an end view of the embodiment shown in FIG. 2.

In the embodiment shown in FIG. 2, a nut 16 is provided for adjusting the tension of the spring 14. The end of the slider member 9 opposite to the end which bears against the head 3 of the rod 1 has a threaded portion 17 onto which the nut 16 can be screw-threaded against the action of the spring 14. Preferably, the nut 16 has six flats and is adapted to be screwed on the slider member 9 by rotation of the slider member 12 around its own axis, a portion of the inner surface of the slider member 12 having a shape corresponding to the six flats of the nut 16 at the height of this latter. Due to the fact that the slider member 12 can be taken to pieces, it is no longer necessary to provide axial play for the slider member 9, so as to be able to withdraw the strands of the thread which remain held in the annular housing defined between the outer surface of the slider member 9 and the inner surface of the slider member 12.

Figure 4:
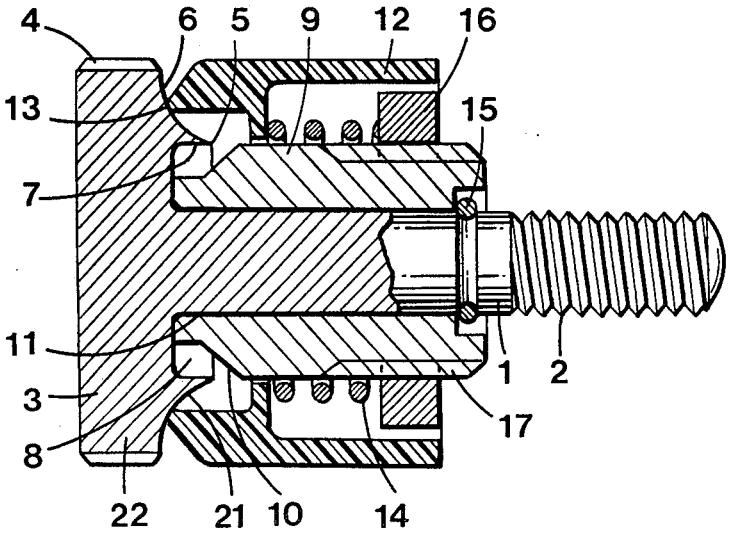
FIG. 4 is a view similar to FIGS. 1 and 2 of a third embodiment of a device in accordance with the present invention.

In the embodiment shown in FIG. 4, the surface of the head 3 facing the rod 1 has a peripheral stop 5 having a cutting edge formed at the intersection of the inner edge of a concave circular groove incurved in the form of a gutter 21, cut into the frusto-conical extension portion 6 of the peripheral edge of the head 3 facing the rod 1, and the outer peripheral edge 7 of the circular groove 8 cut into the surface of the head 3 facing the rod 1. The first slider member 9 is engaged over the rod 1. The end of the slider member 9 facing the head 3 defines a clearance, the end portion comprising a frusto-conical portion 10 so formed as to permit it to penetrate into the groove 8 formed in the head 3. The portion 10 is located along the inner peripheral edge 11 of the groove 8 but is spaced from the outer peripheral edge 7 thereof, and hence away from the stop 5. The slider member 9 is maintained in position by means of a ring 15 mounted in a peripheral groove formed in the rod 1.

The second slider member 12 is engaged over the slide 9 so as to be co-axial with the rod 1 and the end thereof facing the head 3 bears against a concave circular groove 21, against which it is urged by means of the spring 14.

The edge of the end of the slider member 12 is in contact with the base of the concave circular groove 21 and is desirably chamfered in such a manner as to improve its contact with the groove.

The chamfering desirably corresponds to the curvature of the base of the groove 21.

Thus, a thread introduced into the device between the head 3 and the second slider member 12 is held between the base of the groove 21 of the head 3 and the chamfered-edged bearing end 13 of the slider member 12 and slides over the frusto-conical part 10 of the throat of the slider member 9, in the direction of the groove 8, when the thread is pulled. This being done, the thread is forced to pass over the stop 5 which then cuts the thread. A length of the thread can then be withdrawn from the device, while the other part is retained between the groove 21 of the head 3 and the bearing end 13 of the slider member 12.

It can be seen from the drawing that the circular groove 21 causes the thread to be particularly taut when passing over the stop 5 and that the contact between the chamfered edge of the end 13 of the slider member 12 with the base of the concave circular groove 21 ensures an excellent retention of the thread once it has been cut.

We claim:

1. A sewing thread cutting device with thread retention, comprising a rod, said rod comprising a body portion and a head portion, said head portion having a major surface facing said rod, a substantially circular stop member having a cutting edge provided on said major surface of said head portion, a first slider member mounted on said rod and a second slider member mounted on said first slider member, each said slider members having a bearing surface bearing against said head portion of the rod, said substantially circular stop member being disposed between said bearing surface of said first slider member and said bearing surface of said second slider member, said first slider member having an outwardly facing surface and said second slider member having an inwardly facing surface, said outwardly facing surface and said inwardly facing surface jointly defining a substantially annular housing, said substantially circular stop member projecting into said housing.

2. A device as recited in claim 1 wherein said head portion includes a peripheral surface, a portion of said peripheral surface being bevelled in the direction of said rod, said major surface of said head portion defining a substantially circular groove having inner and outer peripheral edges, said outer peripheral edge of said groove and said bevelled portion of said peripheral surface intersecting one another, said stop member being formed at said intersection.

3. A device as recited in claim 2, wherein the first slider member includes a first end region, said first end region defining said bearing surface, said first end region being shaped for insertion into said groove, said insertion being such that said end portion of said first slider member lies adjacent said inner peripheral edge of said groove and is spaced apart from said outer peripheral edge of said groove.

4. A device as recited in claim 2 wherein said second slider member includes a first end region defining said bearing surface, said bearing surface bearing against said bevelled portion of said peripheral surface of said head of said rod, said device further including spring-biassing means for urging said second slider member against said bevelled portion, said spring-biassing means being located at a point beyond said stop, whereby, in use, a portion of a thread introduced between said bevelled portion of said peripheral surface of said head and said bearing surface of said second slider member is retained thereby, the remainder of said thread passing over said stop, being cut and being withdrawn from said device through said annular housing defined between said outwardly facing surface of said first slider member and said inwardly facing surface of said second slider member.

5. A device as recited in claim 2 wherein said body portion of said rod carries a retaining ring, said ring acting on said first slider member so as to permit axial movement of said first slider between said base of said circular groove and said retaining ring.

6. A device as recited in claim 2 wherein said second slider member carries an inwardly directed circular rib and said first slider member includes a cylindrical portion, said rib contacting said cylindrical portion, said device including spring-biassing means for urging said second slider member against said bevelled portion, said first slider member having an end portion defining a frusto-conical portion, said cylindrical portion being located between said spring and said frusto-conical portion to permit limited axial movement of said second slider member and to prevent thread or thread scraps from penetrating into a housing for the spring.

7. A device as recited in claim 2, wherein said peripheral surface of said head portion of said rod defines a frusto-conical extension portion, said frusto-conical extension portion having a concave circular groove in said surface of said head portion facing said rod defining said first circular groove, said stop member being formed at the intersection of said inner edge of said concave circular groove and said outer edge of said first groove.

8. A device as recited in claim 2 wherein said peripheral surface of said head portion of said rod defines a frusto-conical extension portion, said frusto-conical extension portion having a concave circular groove said concave circular groove including a base portion, said second slider member contacting said base, spring-biassing means being provided for urging said second slider member into contact with said base portion.

9. A device as recited in claim 2 wherein said peripheral surface of said head portion of said rod defines a frusto-conical extension portion, said frusto-conical extension portion having a concave circular groove therein, said concave circular groove including a base portion, said second slider member contacting said base, said portion of said second slider member contacting said base being chamfered.

10. A device as recited in claim 9, wherein said chamfered portion of said second slider member is chamfered so as to correspond in shape with the curvature of said base of said concave circular groove.

11. A device as recited in claim 1, wherein said first slider member includes a first end region, said first end region defining said bearing surface, said first end region including a frusto-conical portion, whereby a thread introduced into said housing defined between said outwardly facing surface of said first slider member and said inwardly facing surface of said second slider member is caused to slide on said frusto-conical portion and to pass over said stop.

12. A device as recited in claim 1, wherein said body portion of said rod includes a free end portion remote from said head portion, said free end portion having a screw thread formed thereon, said device further comprising a support member, said support member having a screw-thread portion co-operable with said screw-threaded portion of said free end portion, said first slider member defining a second, free end, portion abutting against said support member.

13. A device as recited in claim 12, wherein said support member is the material presser bar of a sewing maching and wherein said device connects a material presser foot to said material presser bar.

* * * * *